US009724811B2

(12) United States Patent
Liu et al.

(10) Patent No.: US 9,724,811 B2
(45) Date of Patent: Aug. 8, 2017

(54) STEAM POWERED NAILING GUN

(71) Applicant: Taizhou Dajiang Ind. Co., Ltd., Wenling, Zhejiang Province (CN)

(72) Inventors: Gui-Wen Liu, Wenling (CN); Ming-Jun Yang, Wenling (CN); Jin-Quan Huang, Wenling (CN)

(73) Assignee: TAIZHOU DAJIANG IND. CO., LTD., Wenling, Zhejiang Province (CN)

( * ) Notice: Subject to any disclaimer, the term of this patent is extended or adjusted under 35 U.S.C. 154(b) by 518 days.

(21) Appl. No.: 14/550,236

(22) Filed: Nov. 21, 2014

(65) Prior Publication Data

US 2016/0023337 A1 Jan. 28, 2016

(30) Foreign Application Priority Data

Jul. 24, 2014 (CN) ..... 2014 1 0354651
Jul. 24, 2014 (CN) ..... 2014 2 0412774 U

(51) Int. Cl.
*B25C 1/04* (2006.01)
*B25C 1/08* (2006.01)
(Continued)

(52) U.S. Cl.
CPC ..... *B25C 1/041* (2013.01); *B25C 1/048* (2013.01); *B25C 1/08* (2013.01); *B25C 1/008* (2013.01); *B25C 1/04* (2013.01); *B25C 5/1627* (2013.01)

(58) Field of Classification Search
CPC .. B25C 1/00; B25C 1/04; B25C 1/047; B25C 1/041; B25C 1/048; B25C 1/08;
(Continued)

(56) References Cited

U.S. PATENT DOCUMENTS 2,755,783 A * 7/1956 Kupka ..... E02D 7/12 123/46 R
2,987,047 A * 6/1961 Young ..... F01L 23/00 417/398
(Continued)

FOREIGN PATENT DOCUMENTS

CN 2478734 Y 2/2002
CN 1582214 A 2/2005
(Continued)

OTHER PUBLICATIONS

State Intellectual Property Office of the P.R. China (ISR/CN), "International Search Report for PCT/CN2015/082155", China, Sep. 15, 2015.

*Primary Examiner* — Scott A. Smith
(74) *Attorney, Agent, or Firm* — Tim Tingkang Xia, Esq.; Locke Lord LLP

(57) ABSTRACT

The present invention relates to a steam powered nailing gun. In certain embodiments, the steam powered nailing gun includes a handle, a casing, a high pressure water pump, a piston mechanism, a nailing gun base, and a nail magazine. The piston mechanism is connected to the casing. One end of the piston mechanism is connected to the high pressure water pump, and another end is connected to nailing gun base. The nail magazine is disposed at a position corresponding to piston mechanism on the nailing gun base. A phase transition thermal storage device and a steam power generator are positioned inside casing having steam power generator inside phase transition thermal storage device. The steam power generator is connected to high pressure water pump and piston mechanism. The high pressure water pump is further connected to a water supply device 11 on the handle through a second water supply pipe.

20 Claims, 14 Drawing Sheets

(51) Int. Cl.
*B25C 5/16* (2006.01)
*B25C 1/00* (2006.01)

(58) Field of Classification Search
CPC .. B25C 1/008; B25C 1/05; B25C 5/16; B25C 5/1627; E02D 7/00; E02D 7/26
USPC ..... 227/8, 10, 130, 4, 142, 146, 147, 148, 227/140; 123/46 SC, 46 R; 91/309, 317, 91/325, 342; 173/114, 206, 168, 169, 173/209
See application file for complete search history.

(56) References Cited

U.S. PATENT DOCUMENTS 3,721,095 A * 3/1973 Chelminski ..... E02D 7/00 173/1
3,803,840 A * 4/1974 Toczycki ..... B25C 1/00 227/130
3,952,398 A * 4/1976 Haytayan ..... B25C 1/041 227/130
3,967,771 A * 7/1976 Smith ..... B25C 1/08 227/10
4,040,164 A * 8/1977 Briles ..... B25C 1/04 227/130
4,688,645 A * 8/1987 Muller ..... B25C 1/04 173/13
4,739,915 A * 4/1988 Cotta ..... B25C 1/08 123/46 SC
4,811,881 A * 3/1989 Heck ..... B21J 15/105 227/112
5,462,042 A * 10/1995 Greenwell ..... F41B 11/62 124/56
6,102,133 A * 8/2000 Scheid ..... E02D 7/26 173/1
6,371,348 B1 * 4/2002 Canlas ..... B25C 1/008 123/46 SC
7,194,859 B1 * 3/2007 Sawdon ..... F15B 11/0325 60/565
7,494,035 B2 * 2/2009 Weaver ..... B25C 1/04 173/217
8,074,348 B2 * 12/2011 Haytayan ..... B25B 21/002 29/432
8,091,751 B2 * 1/2012 Tanaka ..... B25C 1/008 227/10
2004/0164117 A1 * 8/2004 Nishikawa ..... B25C 1/08 227/10
2005/0056680 A1 * 3/2005 Webb ..... B25C 1/00 227/9

FOREIGN PATENT DOCUMENTS

CN 201500965 U 6/2010
CN 204525370 U 8/2015
WO 2010082851 A1 7/2010

* cited by examiner

STEAM POWERED NAILING GUN

CROSS-REFERENCE TO RELATED APPLICATIONS

This application claims the priority to Chinese Patent Application Nos. 201410354651.0 and 201420412774.0, both filed on Jul. 24, 2014, in the State Intellectual Property Office of P.R. China, which are incorporated herein in their entireties by reference.

FIELD

The present invention mainly relates to the field of nail driving tool, and more particularly to embodiments of steam powered nailing guns.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Currently, compressed air serves as a power source in most nailing guns. When compressed air is used, an air inlet pipe is required to be connected to a body of a nail gun, and pulling and handling the air inlet pipe make such nailing gun difficult to use. In addition, a user usually needs to wear protective earplugs because noise is relatively loud while using such nailing gun powered by compressed air. Moreover, an air compressor is required to provide compressed air. Since the air compressor is bulky, and heavy, the air compressor is difficult to carry from one work site to another work site. The air compressor itself is also costly.

Conventional nailing guns may also use electricity or rechargeable battery as power sources. However, a nail gun requires a strong instantaneous force. Such a strong instantaneous force requires a very high instantaneous current, and the very high instantaneous current may cause coils and batteries to become overheat very easily. Therefore, the duration of its normal use is limited, and the operational lifespan of such a nailing gun is shortened.

Other power sources may also be used in nail guns, such as natural gas or other combustive fuel gas. However, for a nailing gun powered by combustive fuel gas, its structure is rather complex, its failure rate and cost are both high, it is very heavy, and difficult to operate. Not only the combustive fuel gas is expensive, but also the transportation of such gas is a safety hazard.

Therefore, heretofore unaddressed needs exist in the art to address the aforementioned deficiencies and inadequacies.

SUMMARY

The present invention relates to a steam powered nailing gun. The steam powered nailing gun uses a high pressure steam as power source, and overcomes defects that the nailing gun powered by an air compressor has a large size, and very heavy, an electric nailing gun has short service life, and a nailing gun powered by gas is expensive and dangerous.

In one aspect, the present invention relates to a steam powered nailing gun. In certain embodiments, the steam powered nailing gun includes: a handle, a casing, a high pressure water pump, a piston mechanism, a nail magazine, a nailing gun base, a phase transition thermal storage device and a steam power generator. The casing is attached to the handle. The piston mechanism has a first end and an opposite, second end. The piston mechanism is connected to the casing. The first end of the piston mechanism is connected to the high pressure water pump, and the second end of the piston mechanism is connected to the nailing gun base. The nail magazine is attached to the nailing gun base at a position that corresponds to the piston mechanism. Both the phase transition thermal storage device and the steam power generator are positioned inside the casing. The steam power generator is placed inside the phase transition thermal storage device. The steam power generator has a first end connected to the high pressure water pump through a first water supply pipe, and a second end connected to the piston mechanism through a steam pipe. The high pressure water pump is further connected to a water supply device on the handle through a second water supply pipe.

In certain embodiments, the high pressure water pump has a hammering cap, a plunger, an adjustment knob, an upper pump body, a lower pump body, a flange, and a plunger reset spring. The hammering cap is moveably connected to the adjustment knob through the plunger. The upper pump body, the lower pump body, and the flange are fixedly connected together through a plurality of bolts. An upper end of the plunger is in a threaded connection with the hammering cap. A lower end of the plunger successively passes through the adjustment knob and the upper pump body to enter the lower pump body and forms a cavity in the lower pump body. The plunger reset spring is further disposed between the hammering cap and the adjustment knob. The plunger reset spring has a first end and an opposite, second end. The first end of the plunger reset spring is fixedly connected to the hammering cap, and the second end of the plunger set spring is connected to an upper end of the adjustment knob.

In certain embodiments, a guide sleeve is disposed between the plunger and the adjustment knob. The guide sleeve has an upper external thread on an upper end of the guide sleeve, and a lower external thread on a lower end of the guide sleeve. The guide sleeve is connected to the adjustment knob through the upper external thread, and to the upper pump body through the lower external thread. A preloaded spring is further disposed between the plunger and the adjustment knob.

In certain embodiments, a bushing is further disposed between the plunger and the upper pump body for improving coaxiality between the plunger and the upper pump body. A plurality of seal rings is disposed between the upper pump body and the lower pump body, and between the bushing and the lower pump body, respectively. The high pressure water pump further includes a water intake valve, a water discharge valve, and an air suction valve inside the lower pump body. The water intake valve, the water discharge valve, and the air suction valve form a "Y" shaped three distribution channels on a same plane in the lower pump body. The water intake valve is a one-directional valve allowing water to flow into the cavity from outside through the water intake valve. The water discharge valve is also a one-directional valve allowing water to flow out of the cavity through the water discharge valve.

In certain embodiments, a water intake channel is formed at an end of the corresponding water intake valve, a water discharge channel is formed at an end of the corresponding water discharge valve, and an air suction channel is formed at an end of the corresponding air suction valve. The water intake channel, the water discharge channel, and the air suction valve are connected at the cavity inside the lower pump body.

In certain embodiments, the piston mechanism includes a piston body and a spring reset device disposed above the piston body. The piston body has a cylinder cover, a cylinder block, and a piston plate. The cylinder cover is disposed above the cylinder block. The piston plate is disposed inside the cylinder block and is connected to the spring reset device above the piston body. A lower end of the cylinder block is further provided with a buffer block for cushioning impact of the piston plate, and a lower side of the piston plate is connected to a firing pin of the nail magazine.

In certain embodiments, the cylinder cover has a cover body, a valve plate, an exhaust port, and an oil inlet. The valve plate is disposed on an exhaust opening of the cover body through a fixing nut. The exhaust port and the oil inlet are disposed on an outer circumference of the cover body, and an auxiliary heating rod is further provided inside the cover body. The spring reset device has a connecting block having a plurality of connecting points, a pull rod, a plurality of reset springs, and a plurality of brackets. Each of the plurality of reset springs has a first end, and an opposite, second end. The first end of each of the plurality of reset springs is connected to a corresponding connecting point of the connecting block. The second end of each of the plurality of reset springs is connected to a corresponding one of the plurality of brackets. A lower side of the connecting block is fixedly connected to the pull rod. The brackets are fixedly connected to the cylinder cover of the piston body. A lower end of the pull rod passes through the cylinder cover and extends into the cylinder block of the piston body.

In certain embodiments, the phase transition thermal storage device includes a housing, a phase transition material body, and a plurality of heating devices. The phase transition material body is disposed inside the housing. The heating devices are enclosed inside the phase transition material body. The phase transition thermal storage device further includes a temperature sensor, and a temperature controller disposed outside the housing. The temperature sensor has a first end, and an opposite, second end. The first end of the temperature sensor is disposed inside the phase transition material body, and the second end of the temperature sensor is connected to the temperature controller through a wire. The plurality of heating devices is also connected to the temperature controller through another wire. Each of the heating devices has an electric heating rod. The electric heating rod has a resistance wire and a heating jacket. The heating jacket is wrapped on the outer surface of the resistance wire.

In certain embodiments, the steam power generator has a heated body, and a screw plug, a flow diverter, a baffle plate, a column, a base having a first end and an opposite, second end, and a porous material body disposed inside of the heated body. The screw plug is threadedly connected to a front end of the heated body. The screw plug is connected to the flow diverter. The flow diverter is connected to the baffle plate. The baffle plate is connected to the column. The column is connected to the first end of the base. The second end of the base is connected to the porous material body.

In certain embodiments, the flow diverter has a plurality of drainage troughs. The baffle plate is peripherally provided with a plurality of protrusions and a plurality of grooves, and outer edges of the plurality of protrusions abut an inner wall of the heated body.

In certain embodiments, the column has a plurality of narrow grooves on an outer circumference of the column. The width of each of the plurality of narrow grooves is less than 1 mm. The depth of each of the plurality of narrow grooves is also less than 1 mm. A gap is formed between the column and the heated body.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention, and wherein.

DETAILED DESCRIPTION

Figure 1:
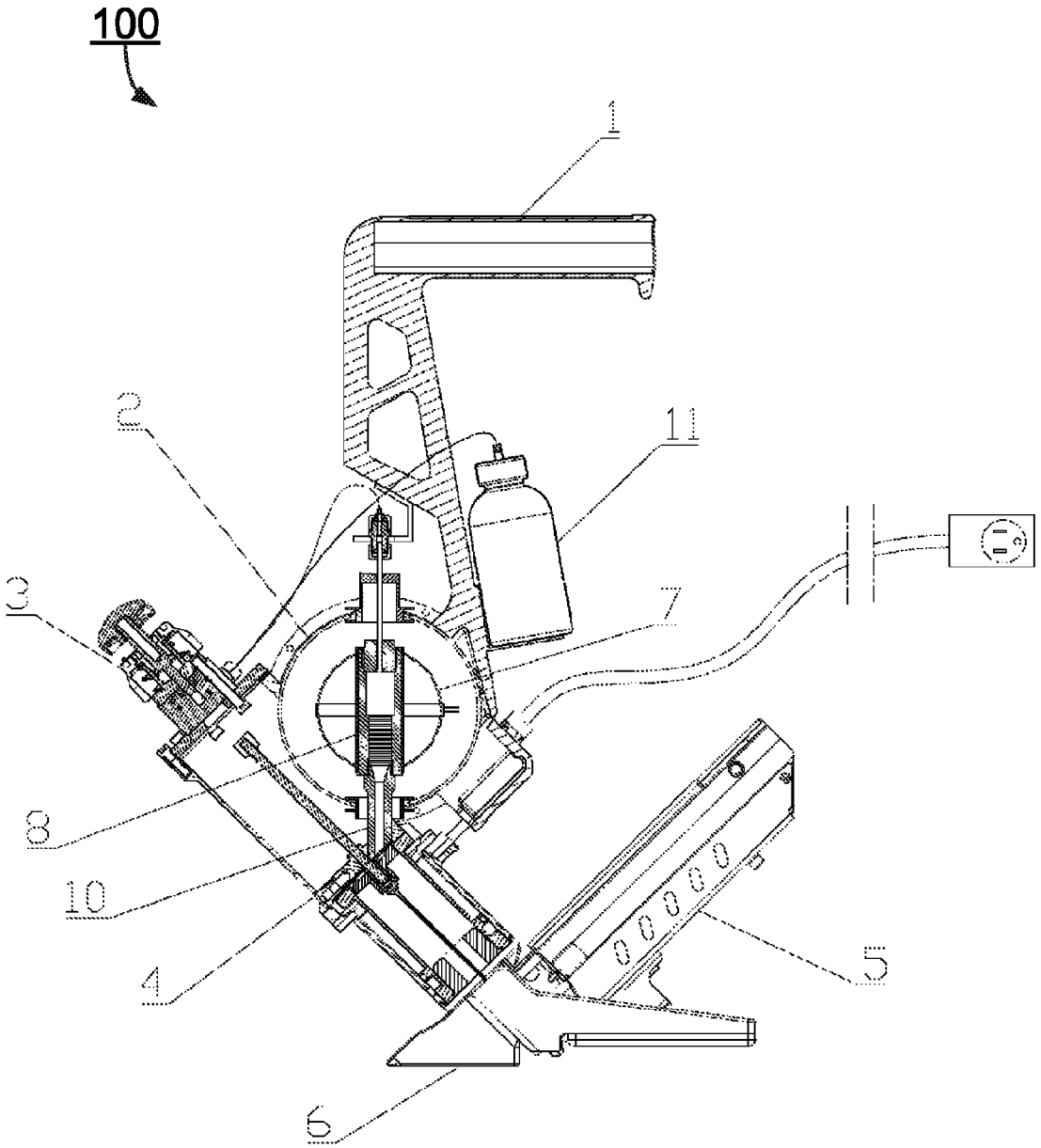
FIG. 1 is a schematic structural view of a steam powered nailing gun according to certain embodiments of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present invention be fully understood, but the present invention may also be implemented by using other manners different from those described herein, so that the present invention is not limited by the specific embodiments disclosed in the following.

The description will be made as to the embodiments of the present invention in conjunction with the accompanying drawings FIGS. 1-14. In accordance with the purposes of this invention, as embodied and broadly described herein, this invention, in one aspect, relates to a steam powered nailing gun 100.

As shown in FIG. 1, in certain embodiments, the steam powered nailing gun 100 includes: a handle 1, a casing 2, a high pressure water pump 3, a piston mechanism 4, a nail magazine 5, a nailing gun base 6, a phase transition thermal storage device 7 and a steam power generator 8. The casing 2 is attached to the handle 1. The piston mechanism 4 has a first end and an opposite, second end. The piston mechanism 4 is connected to the casing 2. The first end of the piston mechanism 4 is connected to the high pressure water pump 3, and the second end of the piston mechanism 4 is connected to the nailing gun base 6. The nail magazine 5 is attached to the nailing gun base 6 at a position that corresponds to the piston mechanism 4.

Both the phase transition thermal storage device 7 and the steam power generator 8 are positioned inside the casing 2. The steam power generator 8 is placed inside the phase transition thermal storage device 7. The steam power generator 8 has a first end connected to the high pressure water pump through a first water supply pipe, and a second end connected to the piston mechanism 4 through a steam pipe. The high pressure water pump 3 is further connected to a water supply device 11 on the handle 1 through a second water supply pipe.

Figure 2:
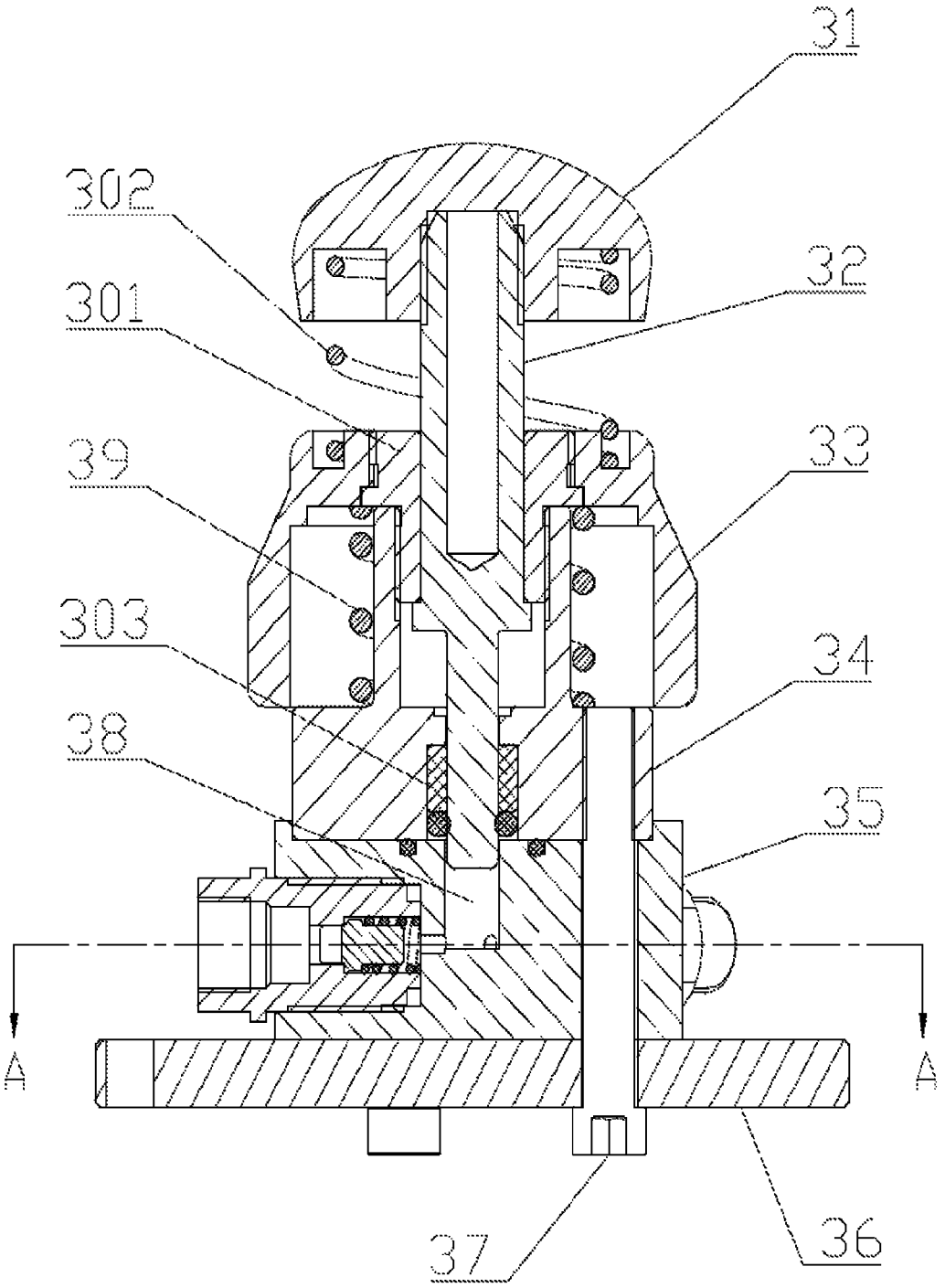
FIG. 2 is a schematic structural view of a high pressure water pump used in the steam powered nailing gun according to one embodiment of the present invention.

In certain embodiments, as shown in FIG. 2, the high pressure water pump 3 has a hammering cap 31, a plunger 32, an adjustment knob 33, an upper pump body 34, a lower pump body 35, a flange 36, and a plunger reset spring 39. The hammering cap 31 is moveably connected to the adjustment knob 33 through the plunger 32. The upper pump body 34, the lower pump body 35, and the flange 36 are fixedly connected together through a plurality of bolts 37. An upper end of the plunger 32 is in a threaded connection with the hammering cap 31, a lower end of the plunger 32 successively passes through the adjustment knob 33 and the upper pump body 34 to enter the lower pump body 35 and forms a cavity 38 in the lower pump body 35. The plunger reset spring 39 is further disposed between the hammering cap 31 and the adjustment knob 33. The plunger reset spring 39 has a first end and an opposite, second end. The first end of the plunger reset spring 39 is fixedly connected to the hammering cap 31, and the second end of the plunger set spring 39 is connected to an upper end of the adjustment knob 33.

The hammering cap 31 is pressed or struck to enable the hammering cap 31 to move up and down relative to the adjustment knob 33. The adjustment knob 33 plays a role of changing a stroke of the plunger 32 through vertical adjustment, thereby changing the volume of the cavity 38, and the larger the volume of the cavity 38 is, the greater the water output amount is, which can provide the steam power generator 8 with a larger amount of water, generating more steam and higher power.

In certain embodiments, a guide sleeve 301 is disposed between the plunger 32 and the adjustment knob 33. The guide sleeve 301 has an upper external thread on an upper end of the guide sleeve 301, and a lower external thread on a lower end of the guide sleeve 301. The guide sleeve 301 is connected to the adjustment knob 33 through the upper external thread, and to the upper pump body 34 through the lower external thread. A preloaded spring 302 is further disposed between the plunger 32 and the adjustment knob 33, which plays a role of giving the adjustment knob 33 an upward preload force, so as to enhance hand feel of the adjustment knob 33.

In certain embodiments, a bushing 303 is further disposed between the plunger 32 and the upper pump body 34 for improving coaxiality between the plunger 32 and the upper pump body 34. A plurality of seal rings is disposed between the upper pump body 34 and the lower pump body 35, and between the bushing 303 and the lower pump body 35, respectively, so as to achieve sealing of the high pressure water pump.

Figure 3:
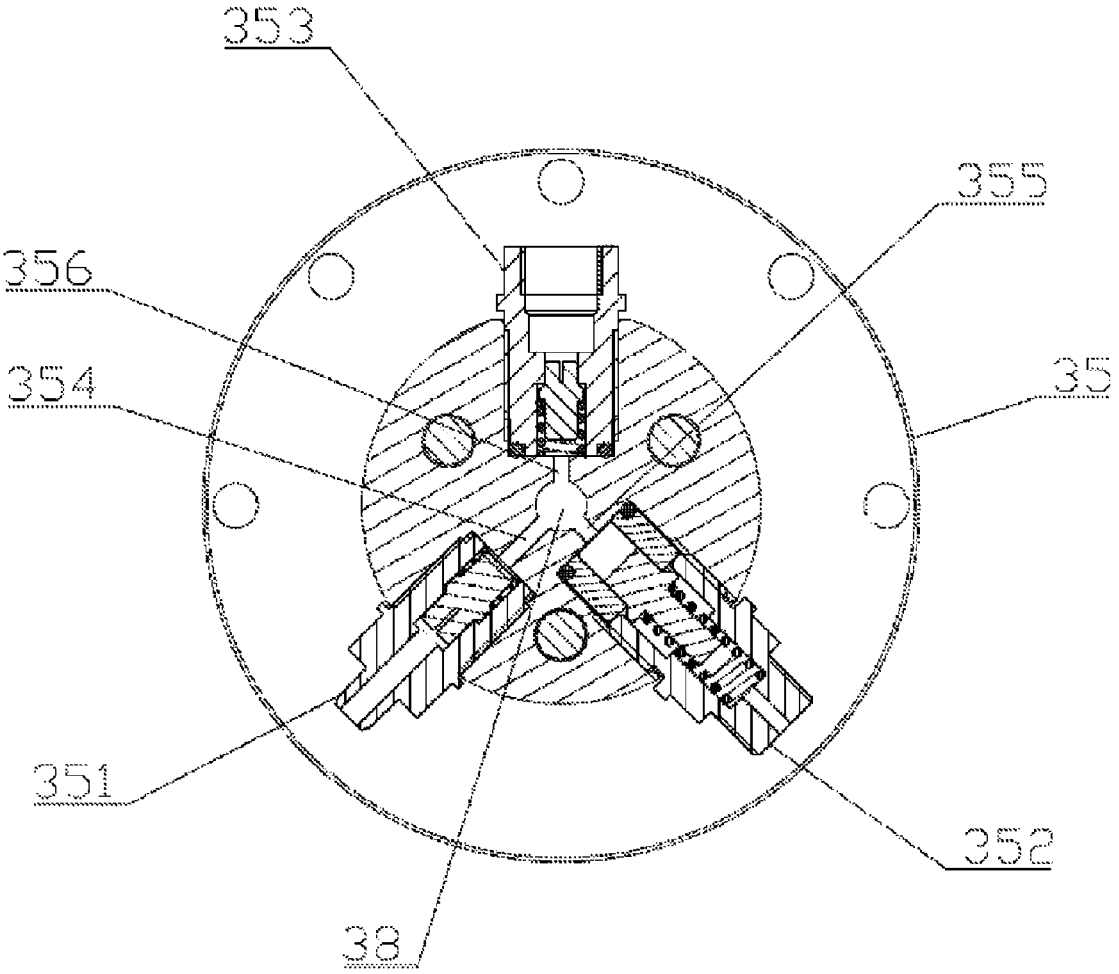
FIG. 3 is a schematic sectional view of a lower pump body of the high pressure water pump along a plane A-A as shown in FIG. 2 according to one embodiment of the present invention.

As shown in FIG. 3, in certain embodiments, the high pressure water pump 3 further includes a water intake valve 351, a water discharge valve 352, and an air suction valve 353, all of them are inside the lower pump body 35. The water intake valve 351, the water discharge valve 352, and the air suction valve 353 form a "Y" shaped three distribution channels on a same plane in the lower pump body 35.

Figure 4:
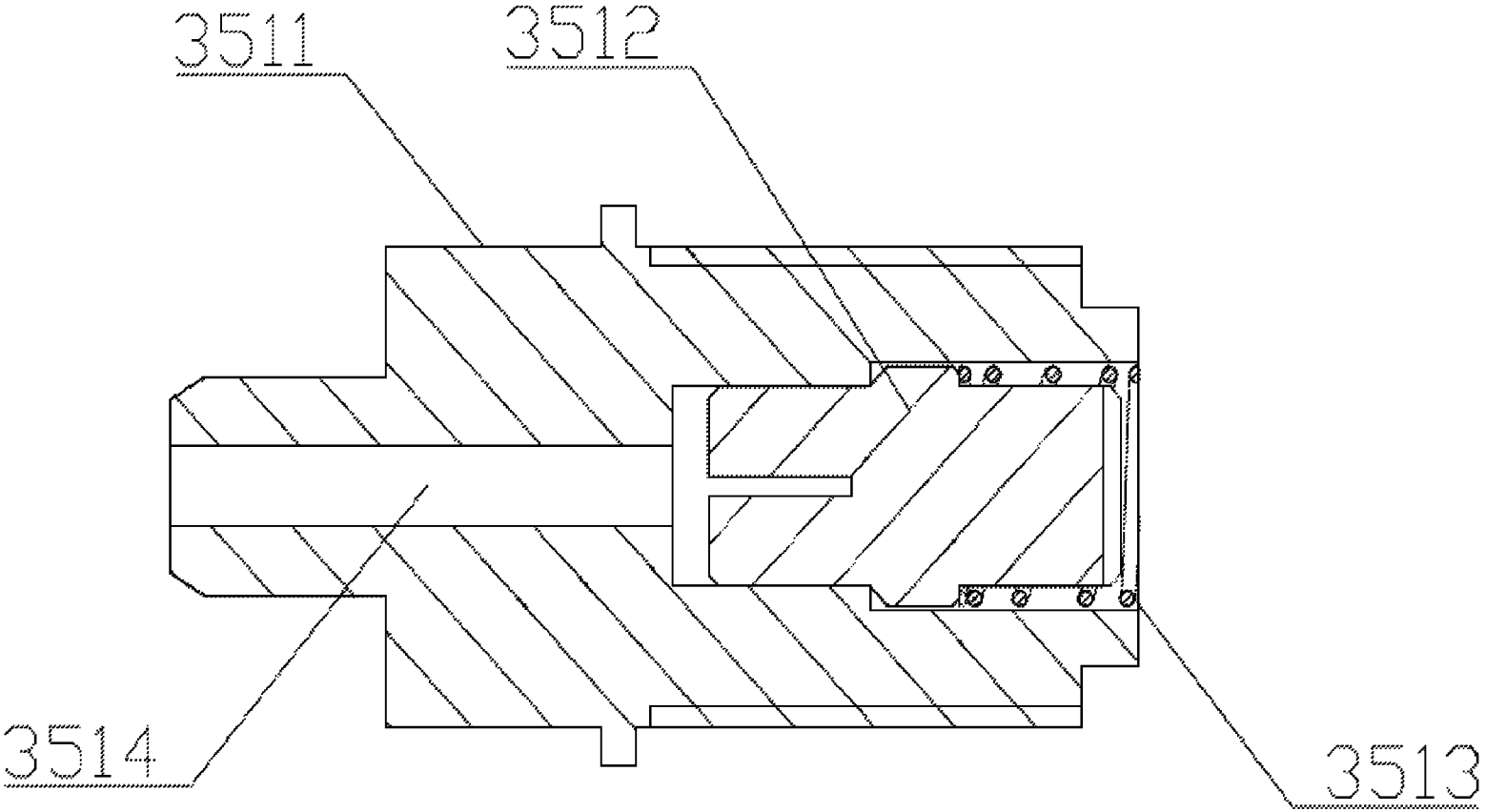
FIG. 4 is a schematic structural view of a water intake valve of the lower pump body of the high pressure water pump according to one embodiment of the present invention.

In certain embodiments, as shown in FIG. 4, a water intake channel 3514 is formed at an end of the corresponding water intake valve 351, the water intake valve 351 includes water inlet valve seat 3511, a water intake valve core 3512 disposed in the water intake valve seat 3511, and a valve core reset spring 3513, and the water intake valve seat 3511 enables, through the valve core reset spring 3513, the water intake valve core 3512 to contact the water intake channel 3514 to seal the water intake valve 351. The water intake valve 351 is a one-directional valve allowing water to flow into the cavity 38 from outside through the water intake valve 351.

Figure 5:
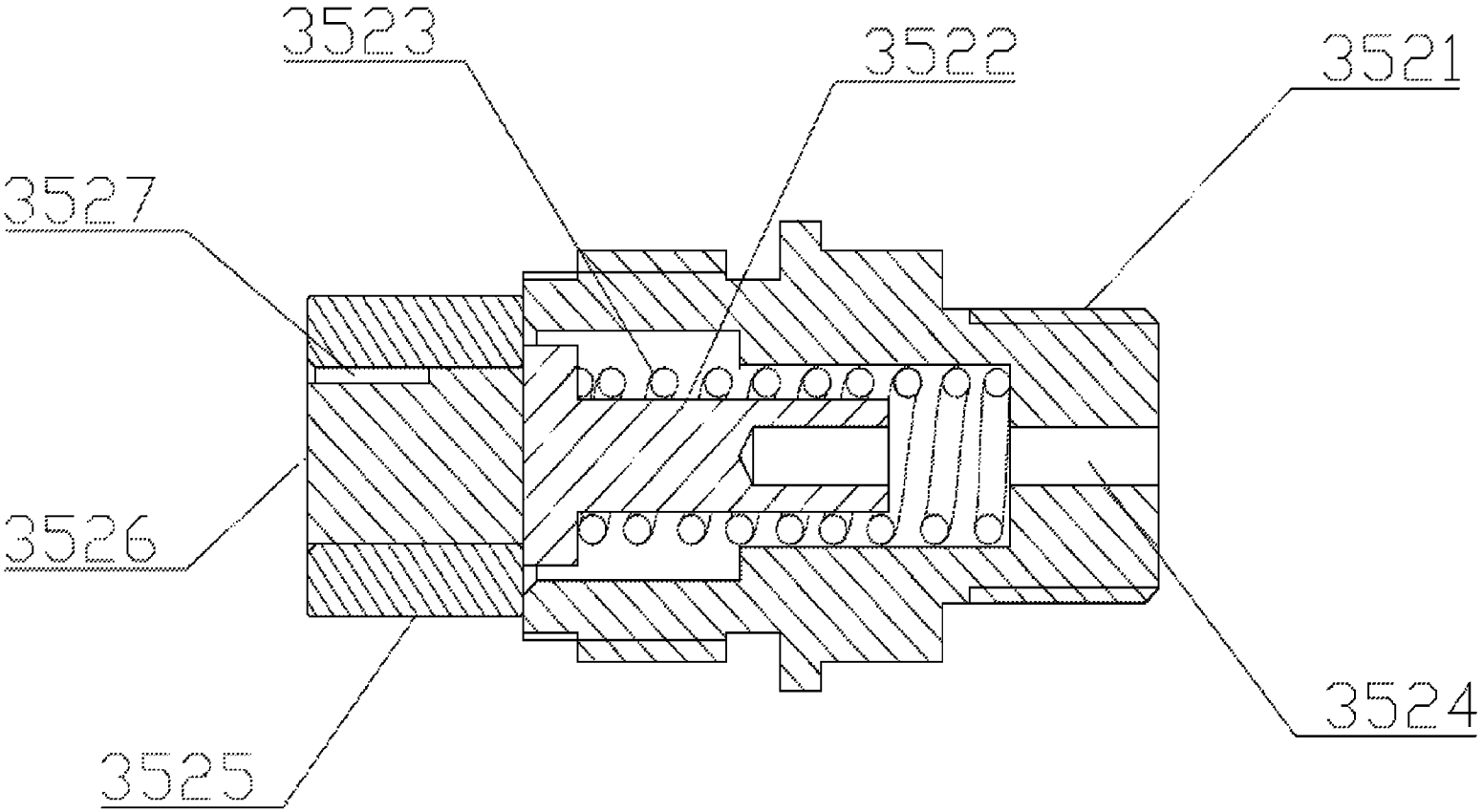
FIG. 5 is a schematic structural view of a water discharge valve of the lower pump body of the high pressure water pump according to one embodiment of the present invention.

In certain embodiments, as shown in FIG. 5, a water discharge channel 3524 is formed at an end of the corresponding water discharge valve 352. The water discharge valve 352 includes a water outlet valve body 3521, a limit rod 3522 disposed in the water discharge valve body 3521, and a limit rod reset spring 3523. A first end of the water discharge valve 352 is further provided with a water discharge valve sleeve 3525 and a water discharge valve core 3526 disposed inside the water discharge valve sleeve 3525. The water discharge valve 352 core 3526 is provided with a notch 3527. During discharge of water, the water discharge valve core 3526 pushes the limit rod 3522 forward, and a water flow enters the water discharge valve body 3521 from the notch 3527 and is discharged from the water discharge channel 3524. The water discharge valve 352 is also a one-directional valve allowing water to flow out of the cavity 38 through the water discharge valve 352.

Figure 6:
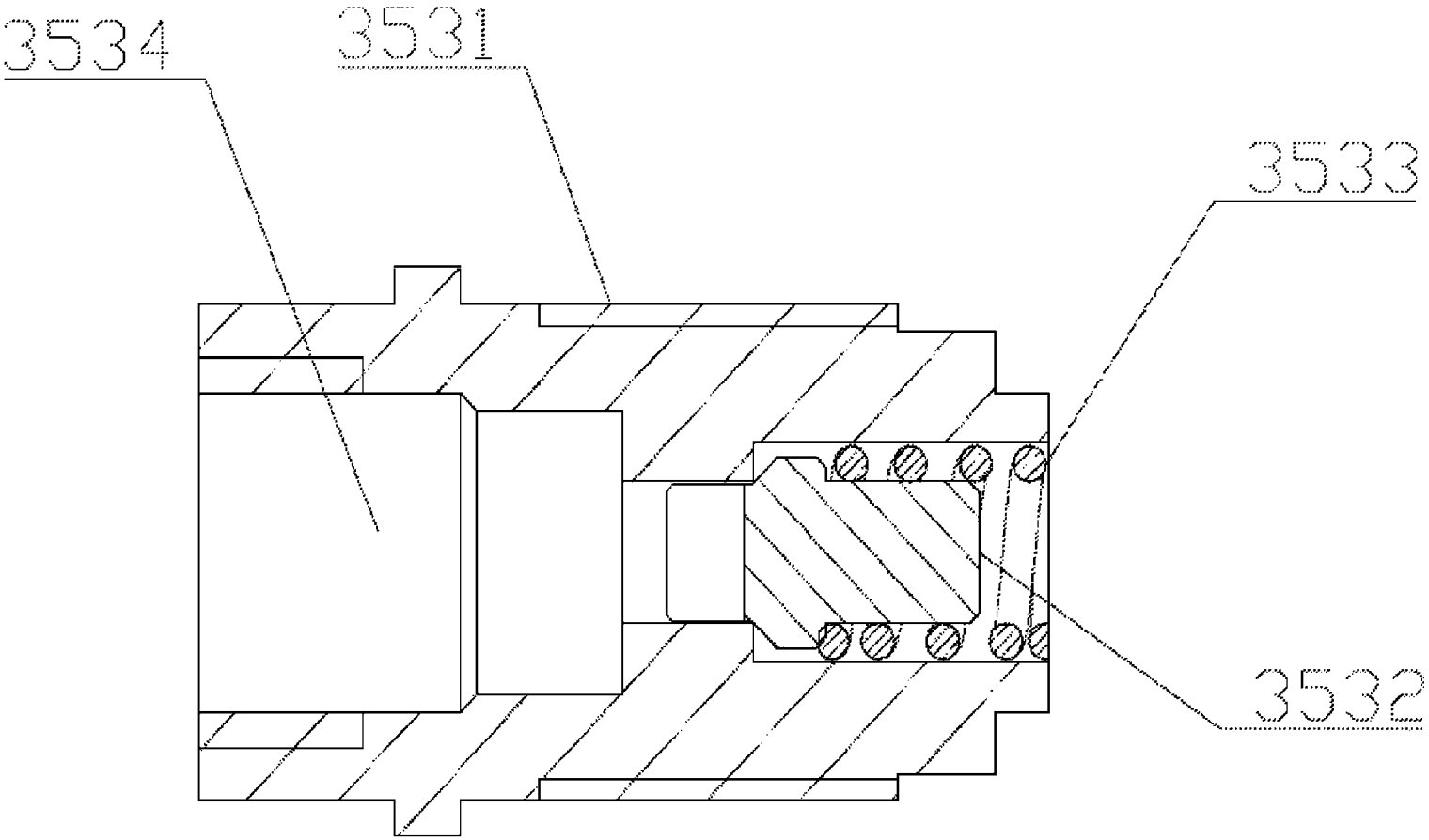
FIG. 6 is a schematic structural view of an air suction valve of the lower pump body of the high pressure water pump according to one embodiment of the present invention.

In certain embodiments, as shown in FIG. 6, an air suction channel 3534 is formed at an end of the corresponding air suction valve 353. The air suction valve 353 includes an air suction valve body 3531, an air suction valve core 3532 disposed inside the air suction valve body 3531, and a compressed spring 3533, where the air suction valve core 3532 abuts the air suction channel 3534 through the compressed spring 3533 to seal the air suction valve 353. The air suction valve 353 is a one-directional valve, and air inside the cavity 38 can only be released by an external force, for example, an air suction device can be used to suck out the air inside the cavity 38.

The structures of the water intake valve 351, the water discharge valve 352, and the air suction valve 353 are not limited the embodiments shown here. The water intake channel 3514, the water discharge channel 3524, and the air suction valve 353 are connected at the cavity 38 inside the lower pump body 35.

Figure 7:
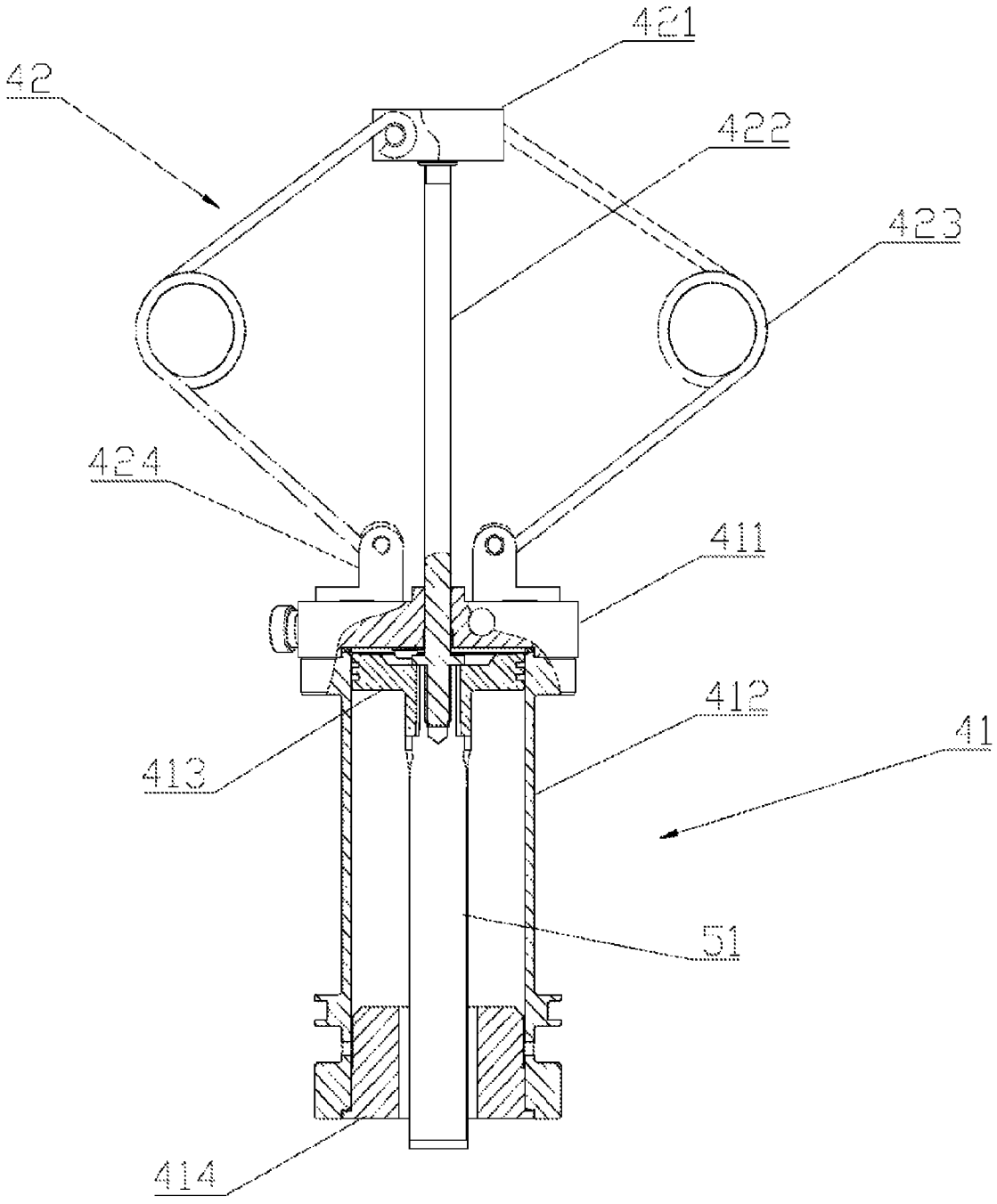
FIG. 7 is a schematic structural view of a piston mechanism according to one embodiment of the present invention.

In certain embodiments, as shown in FIG. 7, the piston mechanism 4 includes a piston body 41 and a spring reset device 42 disposed above the piston body 41. The piston body 41 has a cylinder cover 411, a cylinder block 412, and a piston plate 413. The cylinder cover 411 is disposed above the cylinder block 412. The piston plate 413 is disposed inside the cylinder block 412 and is connected to the spring reset device 42 above the piston body 41. A lower end of the cylinder block 412 is further provided with a buffer block 414 for cushioning impact of the piston plate 413, and a lower side of the piston plate 413 is connected to a firing pin 51 of the nail magazine 5 through threads. A lower end of the cylinder block 412 is further provided with a buffer block 414 for cushioning impact of the piston plate 413. In one embodiment, the buffer block 414 is made of a rubber or nylon material.

The spring reset device 42 has a connecting block 421 having a plurality of connecting points, a pull rod 422, a plurality of reset springs 423, and a plurality of brackets 424. Each of the plurality of reset springs 423 has a first end, and an opposite, second end. The first end of each of the plurality of reset springs 423 is connected to a corresponding connecting point of the connecting block 421. The second end of each of the plurality of reset springs 423 is connected to a corresponding one of the plurality of brackets 424. A lower side of the connecting block 421 is fixedly connected to the pull rod 422. The brackets 424 are fixedly connected to the cylinder cover 411 of the piston body 41. A lower end of the pull rod 422 passes through the cylinder cover 411 and extends into the cylinder block 412 of the piston body 41.

Figure 8:
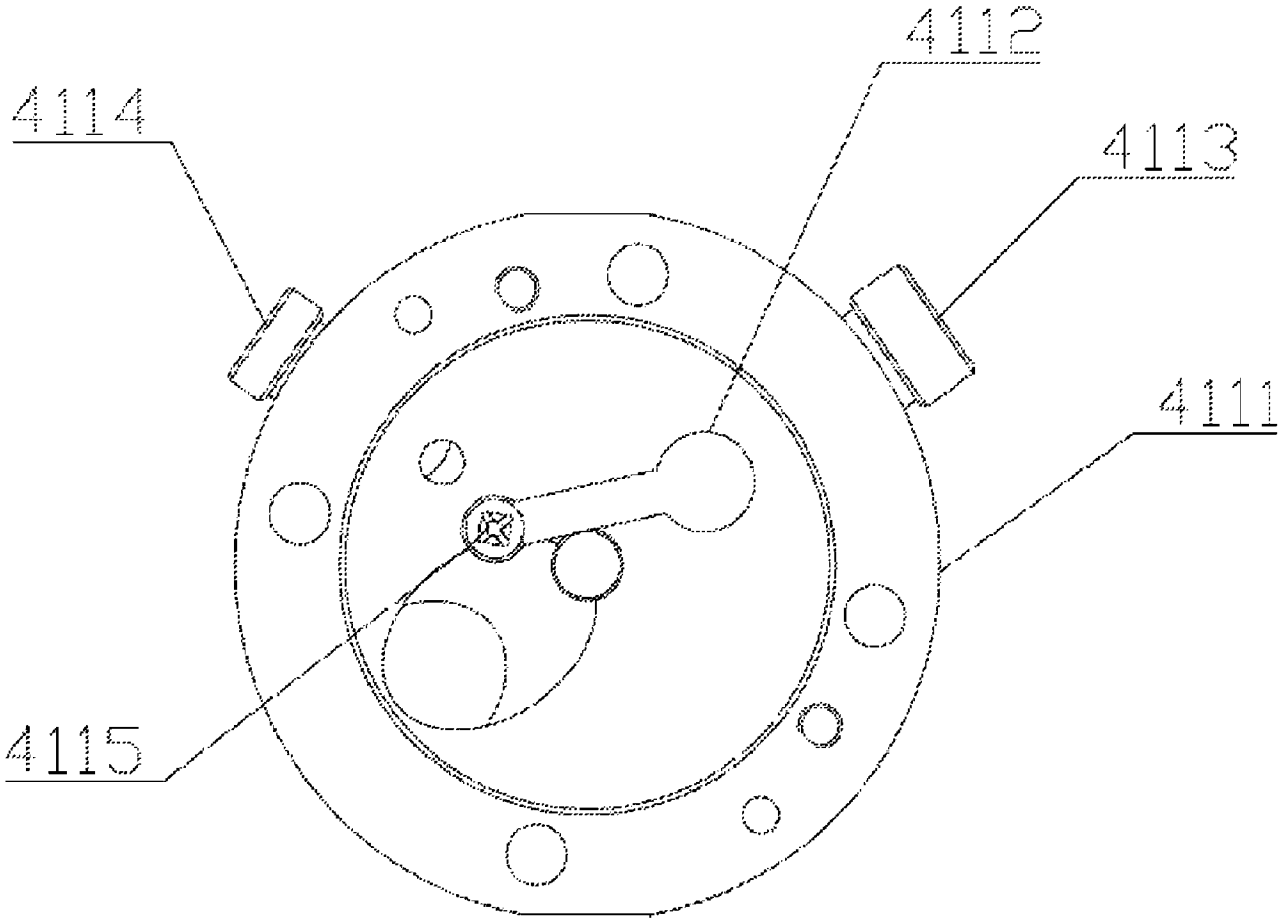
FIG. 8 is a schematic structural view of a cylinder cover of the piston mechanism according to one embodiment of the present invention.
Figure 9:
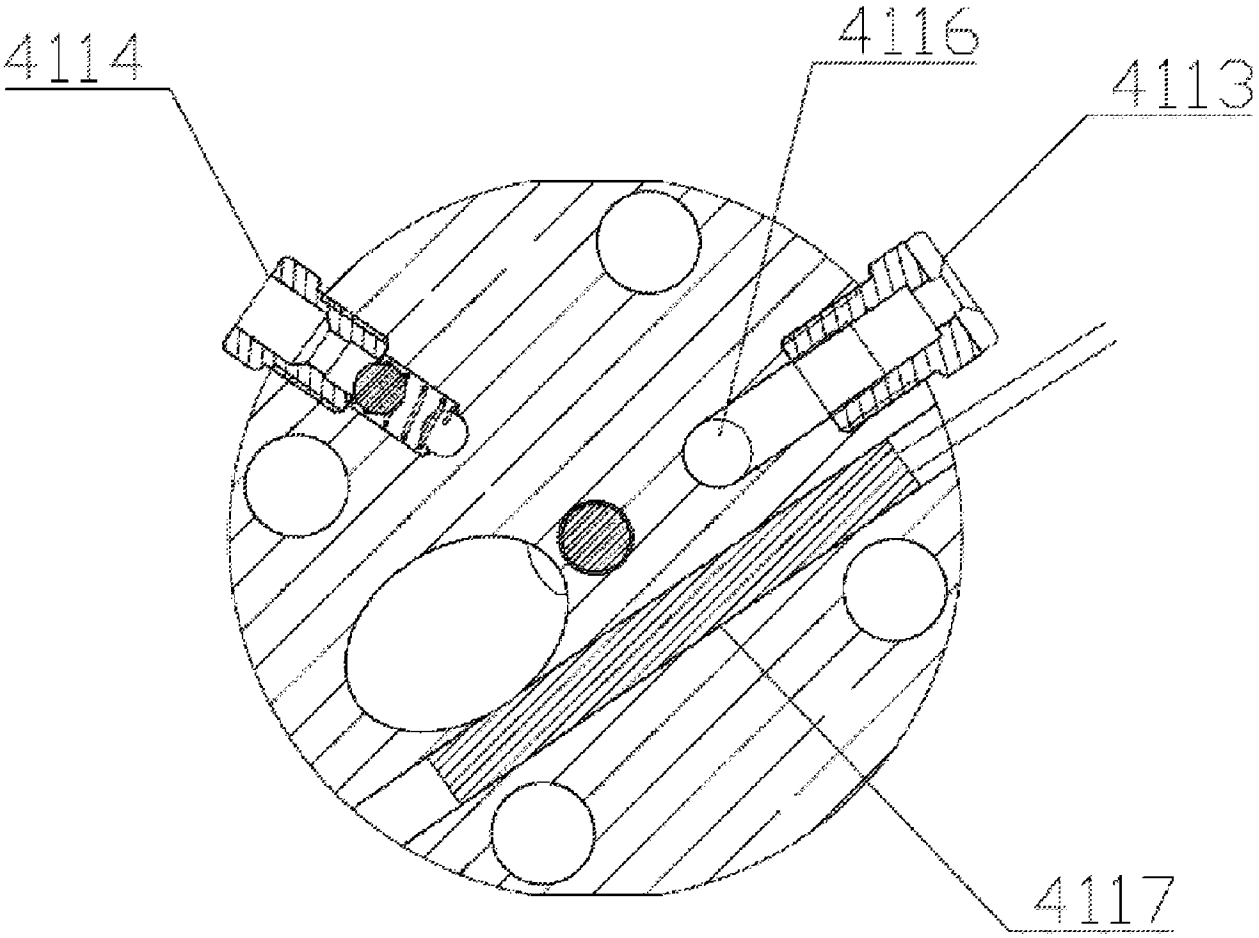
FIG. 9 is a schematic sectional view of the cylinder cover of the piston mechanism according to one embodiment of the present invention.

In certain embodiments, as shown in FIG. 8 and FIG. 9, the cylinder cover 411 has a cover body 4111, a valve plate 4112, an exhaust port 4113, and an oil inlet 4114. The valve plate 4112 is disposed on an exhaust opening 4116 of the cover body 4111 through a fixing nut 4115. The exhaust port 4113 is connected to the exhaust opening 4116. The exhaust port 4113 and the oil inlet 4114 are disposed on an outer circumference of the cover body 4111, and an auxiliary heating rod 4117 is further provided inside the cover body 4111 which plays a role of preheating air in the cylinder block 412, improving an effect of steam compression, and increasing the pressure, so as to cope with a problem of insufficient piston pressure caused by cold weather. In an initial state, the valve plate 4112 is located above the exhaust opening 4116 and in an open state. When subject to internal pressure from the cylinder block 412, the valve plate 4112 may close the exhaust opening 4116, and the exhaust opening 4116 may be opened again when the pressure disappears. The oil inlet 4114 is a one-directional valve.

Figure 10:
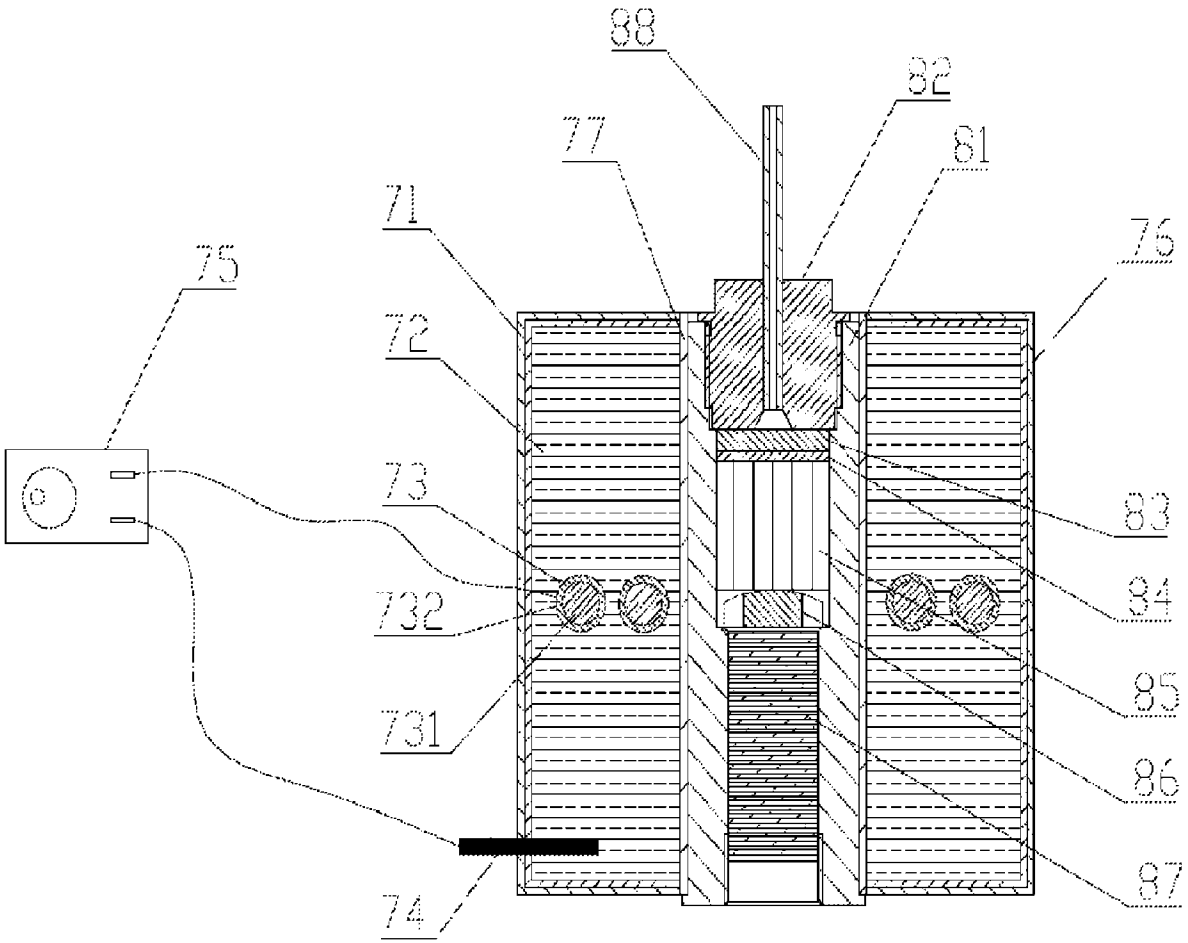
FIG. 10 is a schematic structural view of a phase transition thermal storage device and a steam power generator according to one embodiment of the present invention.

In certain embodiments, as shown in FIG. 10, the phase transition thermal storage device 7 includes a housing 71, a phase transition material body 72, and a plurality of heating devices 73. The phase transition material body 72 is disposed inside the housing 71. The heating devices 73 are enclosed inside the phase transition material body 72. The phase transition thermal storage device 7 further includes a temperature sensor 74, and a temperature controller 75 disposed outside the housing 71. The temperature sensor 74 has a first end, and an opposite, second end. The first end of the temperature sensor 74 is disposed inside the phase transition material body 72, and the second end of the temperature sensor 74 is connected to the temperature controller 75 through a wire. The plurality of heating devices 73 is also connected to the temperature controller 75 through another wire. Each of the heating devices 73 has an electric heating rod. The electric heating rod has a resistance wire 731 and a heating jacket 732. The heating jacket 732 is wrapped on the outer surface of the resistance wire 731.

In certain embodiments, the steam power generator 8 is disposed inside the phase transition thermal storage device 7, and a heat-resistant steel heated sleeve 77 is further disposed between the phase transition material body 72 and the steam power generator 8. The steam power generator 8 has a heated body 81, and a screw plug 82, a flow diverter 83, a baffle plate 84, a column 85, a base 86 having a first end and an opposite, second end, and a porous material body 87 disposed inside of the heated body 81. The heated body 81 transfers heat of the phase transition thermal storage device 7 to the column 85 and the porous material body 87. The screw plug 82 is threadedly connected to a front end of the heated body 81. The screw plug 82 is connected to the flow diverter 83. The flow diverter 83 is connected to the baffle plate 84. The baffle plate 84 is connected to the column 85. The column 85 is connected to the first end of the base 86. The second end of the base 86 is connected to the porous material body 87. The screw plug 82 is further connected to a water intake pipe 88, and water flows toward the flow diverter 83 and the baffle plate 84 through the water intake pipe 88.

It should be noted that, even if there is no phase transition thermal storage device 7, the function of the phase transition thermal storage device 7 may also be implemented by directly using any other heating device or heat source to heat the steam power generator 8.

Figure 11:
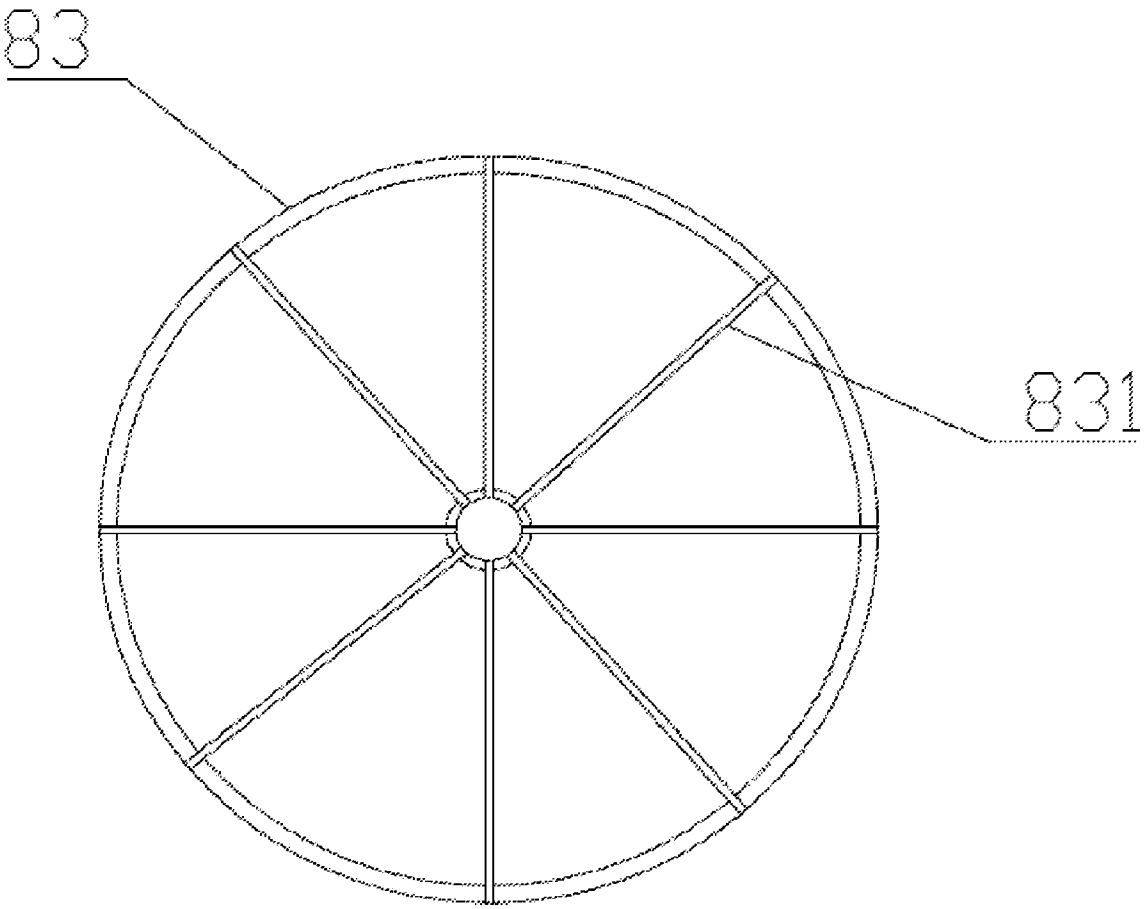
FIG. 11 is a schematic structural view of a flow diverter of the steam power generator according to one embodiment of the present invention.

In certain embodiments, as shown in FIG. 11, the flow diverter 83 has multiple drainage troughs 831, and water flow enters the drainage troughs 831 from the water intake pipe 88.

Figure 12:
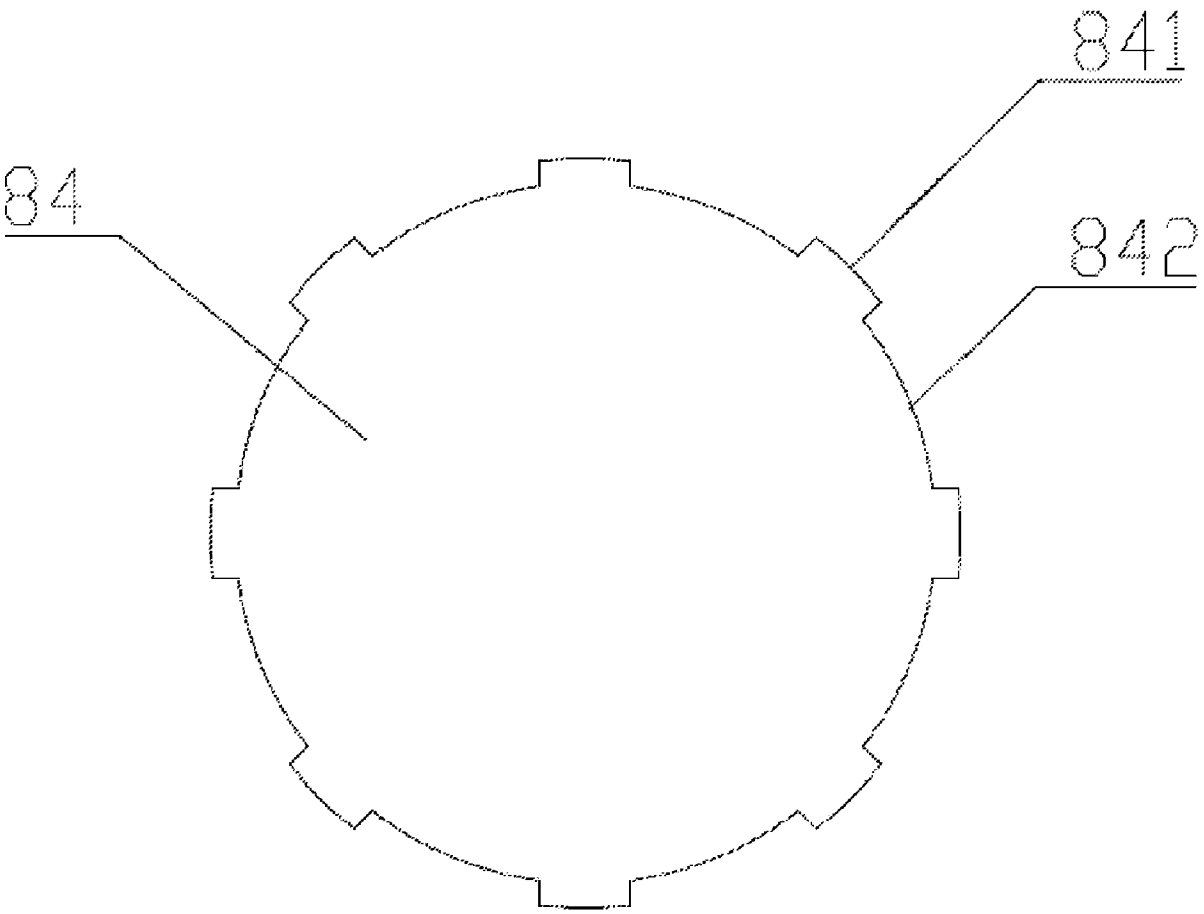
FIG. 12 is a schematic structural view of a baffle plate of the steam power generator according to one embodiment of the present invention.

In certain embodiments, as shown in FIG. 12, the baffle plate 84 is peripherally provided with multiple protrusions 841 and grooves 842. Outer edges of the protrusions 841 abut an inner wall of the heated body 81. Water flow in the drainage troughs 831 enters one side of the column 85 through the grooves 842.

Figure 13:
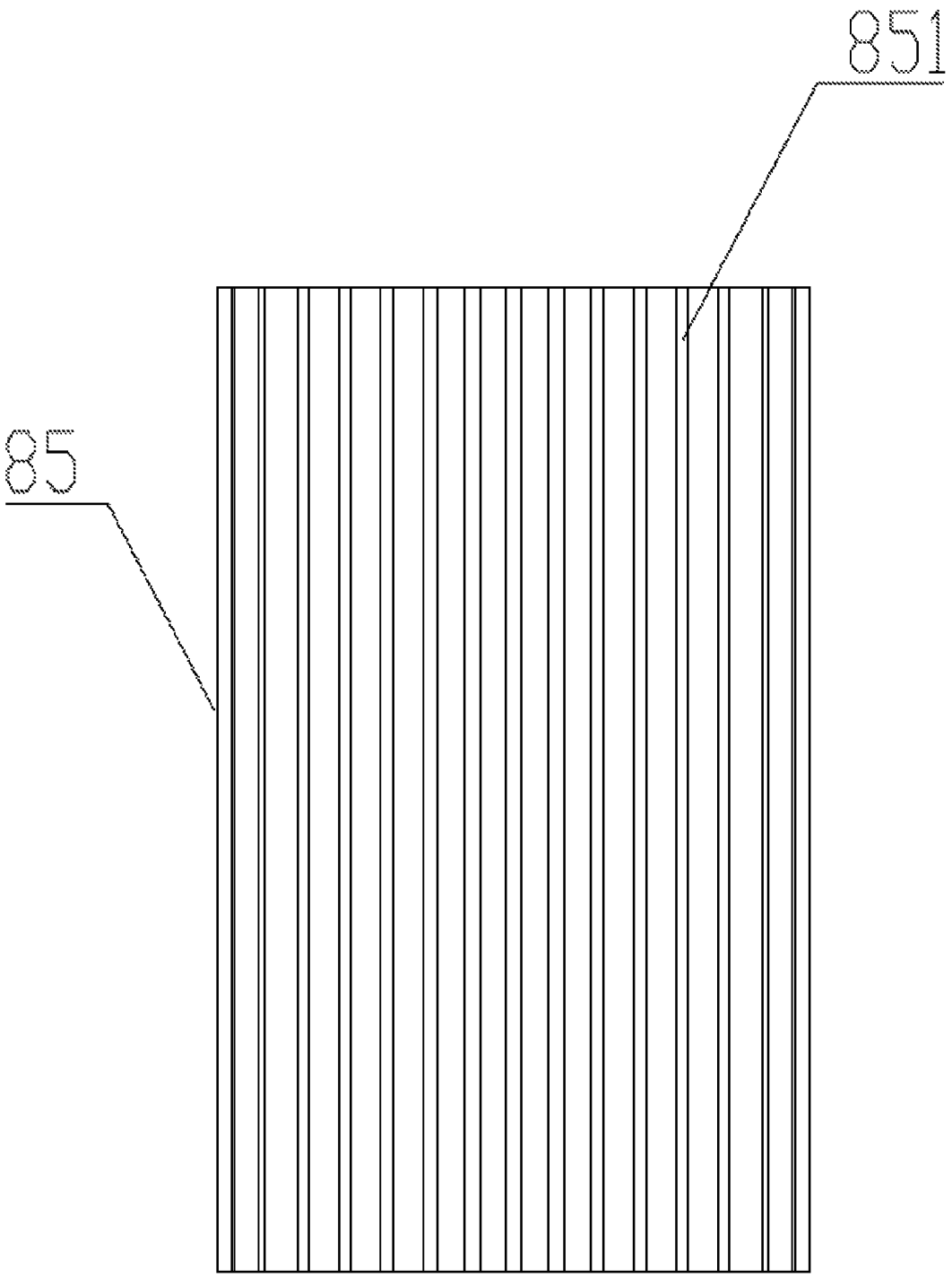
FIG. 13 is a schematic structural view of a column of the steam power generator according to one embodiment of the present invention.
Figure 14:
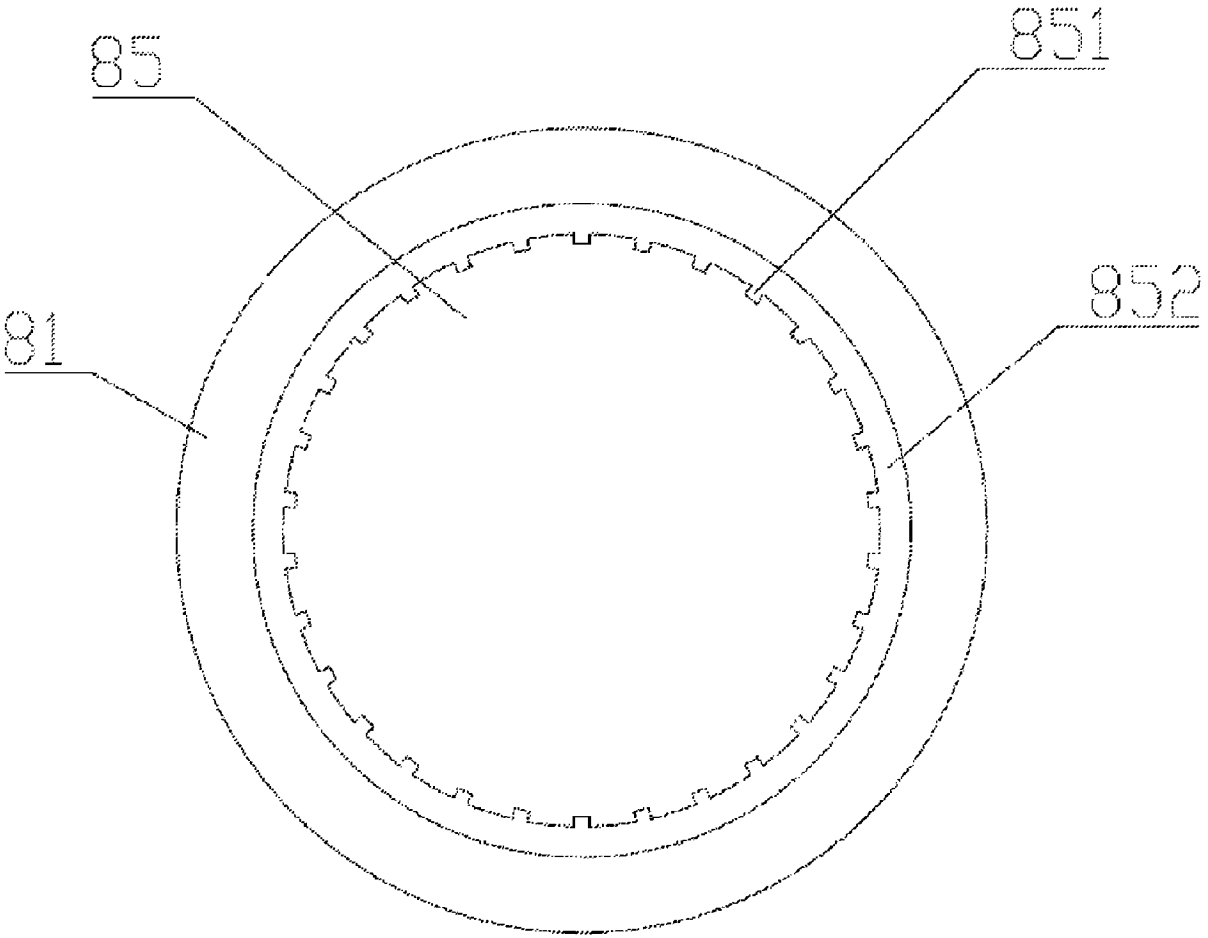
FIG. 14 is a schematic structural view of the column and a heated body of the steam power generator according to one embodiment of the present invention.

As shown in FIG. 13 and FIG. 14, a plurality of narrow grooves 851 is disposed on an outer circumference of the column 85. A gap 852 is formed between the column 85 and the heated body 81. Water flow from the flow diverter 83 and the baffle plate 84 reaches a high-temperature saturated state after being heated through the narrow grooves 851 and the gap 852. The column 85 is made of a copper material with desirable thermal conductivity. The width of each of the plurality of narrow grooves 851 is less than 1 mm. The depth of each of the plurality of narrow grooves 851 is also less than 1 mm.

The water flow that reaches the high-temperature saturated state passes through the narrow grooves 851 and the gap 852 to be rapidly shot to the porous material body 87. As the porous material body 87 receives the heat from the phase transition thermal storage device 7 to have a temperature higher than 400° C., when the water flow in the high-temperature saturated state is fast shot to the porous material body 87, the water flow evaporates and vaporizes quickly to turn into high-temperature, high pressure steam, and the steam passes through a steam pipe 10 as shown in FIG. 1 to enter the cylinder block 412 of the piston body 41 to push the piston plate 413 to move.

The porous material body 87 is manufactured with a desirable high-temperature resistant and oxidation resistant material, as long as the material can conduct heat, and is designed to be porous in order to increase the heat exchanging area, and improve the steam generation efficiency.

Referring back to FIG. 1, the working process of the present invention is as follows:

1. A water supply device 11 supplies the high pressure water pump 3 with a water source through the first water supply pipe 9. Water flow passes through the water intake valve 351 of the high pressure water pump 3 to enter the cavity 38 of the lower pump body 35.

2. A hammer may be used to strike the hammering cap 31, the plunger 32 moves fast downwards, and under strong impact, the water in the cavity 38 is fast transported into the steam power generator 8 through the water discharge valve 352 and the second water supply pipe 12.

3. The steam power generator 8 turns the water into high pressure steam, and transports the steam into the piston mechanism 4 through a steam pipe 10.

4. The piston plate 413, driven by the high pressure steam, moves at a high speed, and drives the firing pin 51 to move downwards at a high speed, so as to strike a nail in the nail magazine 5 into an object that needs nailing such as a floor plank.

5. When the piston mechanism 4 completes a nailing action, the reset spring 423 pulls the push rod 422 and the piston plate 413 upwards, so as to reset the piston plate 413 to prepare for next nailing action.

The present invention uses high pressure steam as a power source, ordinary liquid water is turned into high pressure steam to drive a piston mechanism to work, and drive a firing pin to drive a nail into an object. As steam is used as a power source, compared with air compression, electrical power supply, rechargeable batteries or gases, the steam powered nailing gun has a compact size, light weight, low cost, and is easy to carry and transport and safe and reliable to use. It may effectively save the cost for enterprises, and improve economic efficiency of the enterprises.

The power supply required in the present invention may be a domestic or industrial alternating current, or may be provided by a rechargeable battery.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A steam powered nailing gun, comprising:

a handle;

a casing, attached to the handle;

a high pressure water pump;

a piston mechanism having a first end and an opposite, second end, wherein the piston mechanism is connected to the casing, and the first end of the piston mechanism is connected to the high pressure water pump;

a nailing gun base, wherein the second end of the piston mechanism is connected to the nailing gun base; and a nail magazine disposed on the nailing gun base at a position that corresponds to the piston mechanism, wherein a phase transition thermal storage device and a steam power generator are positioned inside the casing, the steam power generator is disposed inside the phase transition thermal storage device, a first end of the steam power generator is connected to the high pressure water pump through a first water supply pipe, a second end of the steam power generator is connected to the piston mechanism through a steam pipe, the high pressure water pump is further connected to a water supply device disposed on the handle, and the water supply device is connected to the high pressure water pump through a second water supply pipe.

2. The steam powered nailing gun according to claim 1, wherein the high pressure water pump comprises a hammering cap, a plunger, an adjustment knob, an upper pump body, a lower pump body, and a flange, the hammering cap is moveably connected to the adjustment knob through the plunger, the upper pump body, the lower pump body, and the flange are fixedly connected together through a plurality of bolts, the top of the plunger is in a threaded connection with the hammering cap, a lower end of the plunger successively passes through the adjustment knob and the upper pump body to enter the lower pump body and forms a cavity in the lower pump body, a plunger reset spring having a first end and an opposite, second end, is further disposed between the hammering cap and the adjustment knob, the first end of the plunger reset spring is fixedly connected to the hammering cap, and the second end of the plunger reset spring abuts on the top of the adjustment knob.

3. The steam powered nailing gun according to claim 2, wherein a guide sleeve having an upper external thread on an upper end of the guide sleeve, and a lower external thread on a lower end of the guide sleeve, is disposed between the plunger and the adjustment knob, the guide sleeve is connected to the adjustment knob through the upper external thread, and to the upper pump body through the lower external thread, and a preloaded spring is further disposed between the plunger and the adjustment knob.

4. The steam powered nailing gun according to claim 3, wherein a bushing for improving coaxiality between the plunger and the upper pump body is further disposed between the plunger and the upper pump body, and a plurality of seal rings is respectively disposed between the upper pump body and the lower pump body and between the bushing and the lower pump body.

5. The steam powered nailing gun according to claim 4, wherein a water intake valve, a water discharge valve, and an air suction valve are further disposed inside the lower pump body, and form a "Y" shaped three distribution channels on a same plane in the lower pump body.

6. The steam powered nailing gun according to claim 5, wherein water inlet valve is a one-directional valve allowing a water flow into the cavity from outside through the water intake valve.

7. The steam powered nailing gun according to claim 5, wherein the water discharge valve is a one-directional valve allowing water to flow out of the cavity through the water discharge valve.

8. The steam powered nailing gun according to claim 5, wherein, a water intake channel is formed at an end of the corresponding water intake valve, a water discharge channel is formed at an end of the corresponding water discharge valve, an air suction channel is formed at an end of the corresponding air suction valve, and the water intake channel, the water discharge channel, and the air suction valve are connected at the cavity inside of the lower pump body.

9. The steam powered nailing gun according to claim 8, wherein the piston mechanism comprises a piston body and a spring reset device disposed above the piston body, the piston body comprises a cylinder cover, a cylinder block, and a piston plate, the cylinder cover is disposed above the cylinder block, the piston plate is disposed inside of the cylinder block and is connected to the spring reset device above the piston body, the bottom of the cylinder block is further provided with a buffer block for cushioning impact of the piston plate, and a lower side of the piston plate is connected to a firing pin of the nail magazine.

10. The steam powered nailing gun according to claim 9, wherein the cylinder cover comprises a cover body, a valve plate, an exhaust port, and an oil inlet, the valve plate is disposed on an exhaust hole of the cover body through a fixing nut, the exhaust port and the oil inlet are disposed on an outer circumference of the cover body, and an auxiliary heating rod is further provided inside of the cover body.

11. The steam powered nailing gun according to claim 10, wherein the spring reset device comprises a connecting block, a pull rod, a plurality of reset springs having a first end, and an opposite, second end, and a plurality of brackets, the first end of each of plurality of reset springs is connected to the connecting block, and the second end of each of the plurality of reset springs is connected a corresponding one of the plurality of brackets, a lower side of the connecting block is fixedly connected to the pull rod, the plurality of brackets is fixedly connected to the cylinder cover of the piston body, and a lower end of the pull rod passes through the cylinder cover to extend into the cylinder block of the piston body.

12. The steam powered nailing gun according to claim 11, wherein the phase transition thermal storage device comprises a housing, a phase transition material body, and a plurality of heating devices, the phase transition material body is disposed inside of the housing, the plurality of heating devices pass through the housing and is embedded inside the phase transition material body.

13. The steam powered nailing gun according to claim 12, wherein the phase transition thermal storage device further comprises a temperature sensor having a first end, and an opposite, second end, and a temperature controller, the first end of the temperature sensor is disposed inside of the phase transition material body, the second end of the temperature sensor is connected, through a wire, to the temperature controller disposed outside the housing, and the plurality of heating devices is also connected to the temperature controller through another wire.

14. The steam powered nailing gun according to claim 13, wherein the plurality of heating devices is enclosed inside of the phase transition material body.

15. The steam powered nailing gun according to claim 14, wherein the plurality of heating devices comprises a plurality of electric heating rods having a plurality of resistance wires with a plurality of heating jackets wrapped on the outer surfaces of the plurality of resistance wires.

16. The steam powered nailing gun according to claim 1, wherein the steam power generator comprises a heated body, and a screw plug, a flow diverter, a baffle plate, a column, a base having a first end and an opposite, second end, and a porous material body disposed inside of the heated body, the screw plug is threadedly connected to a front end of the heated body, the screw plug is successively connected to the flow diverter and the baffle plate, the baffle plate is connected to the column, the column is connected to the first end of the base, and the second end of the base is connected to the porous material body.

17. The steam powered nailing gun according to claim 16, wherein the flow diverter comprises a plurality of drainage troughs, the baffle plate is peripherally provided with a plurality of protrusions and a plurality of grooves, and outer edges of the plurality of protrusions abut an inner wall of the heated body.

18. The steam powered nailing gun according to claim 17, wherein a plurality of narrow grooves is disposed on an outer circumference of the column.

19. The steam powered nailing gun according to claim 18, wherein widths and depths of the plurality of narrow grooves are smaller than 1 mm.

20. The steam powered nailing gun according to claim 19, wherein a gap is formed between the column and the heated body.

* * * * *